US007794204B2

(12) United States Patent
Stevens et al.

(10) Patent No.: US 7,794,204 B2
(45) Date of Patent: Sep. 14, 2010

(54) AXIAL FAN ASSEMBLY

(75) Inventors: William Stevens, Maynard, MA (US); Robert W. Stairs, Westwood, MA (US)

(73) Assignee: Robert Bosch GmbH, Stuttgart (DE)

( * ) Notice: Subject to any disclaimer, the term of this patent is extended or adjusted under 35 U.S.C. 154(b) by 744 days.

(21) Appl. No.: 11/755,983

(22) Filed: May 31, 2007

(65) Prior Publication Data

US 2007/0280829 A1 Dec. 6, 2007

Related U.S. Application Data

(60) Provisional application No. 60/803,576, filed on May 31, 2006.

(51) Int. Cl.
*F04D 29/38* (2006.01)

(52) U.S. Cl. ..... 415/220; 415/211.2; 415/228; 416/189; 416/238; 416/241 R

(58) Field of Classification Search ..... 416/238, 416/189, 234, 241 R; 415/220, 228
See application file for complete search history.

(56) References Cited

U.S. PATENT DOCUMENTS

| | | | | |
|---|---|---|---|---|
| 4,358,245 | A | 11/1982 | Gray | |
| 4,569,632 | A | 2/1986 | Gray, III | |
| 4,684,324 | A | 8/1987 | Perosino | |
| 4,930,990 | A * | 6/1990 | Brackett | 416/223 R |
| 5,244,347 | A | 9/1993 | Gallivan et al. | |
| 5,297,931 | A * | 3/1994 | Yapp et al. | 415/208.1 |
| 5,393,199 | A | 2/1995 | Alizadeh | |
| 5,489,186 | A | 2/1996 | Yapp et al. | |
| 5,520,513 | A * | 5/1996 | Kuroki et al. | 415/223 |
| 5,577,888 | A | 11/1996 | Capdevila et al. | |
| 5,582,507 | A | 12/1996 | Alizadeh | |
| 5,624,234 | A | 4/1997 | Neely et al. | |
| 5,701,854 | A | 12/1997 | Hauser | |
| 5,730,583 | A | 3/1998 | Alizadeh | |

(Continued)

FOREIGN PATENT DOCUMENTS

EP 0704625 A2 4/1996

(Continued)

OTHER PUBLICATIONS

Stevens, William and Stairs, Robert W., Axial Fan Assembly, U.S. Appl. No. 11/755,988, filed May 31, 2007.

*Primary Examiner*—Ninh H Nguyen
(74) *Attorney, Agent, or Firm*—Michael Best & Friedrich LLP

(57) ABSTRACT

The present invention provides an axial fan including a hub adapted for rotation about a central axis and a plurality of blades extending radially outwardly from the hub and arranged about the central axis. Each of the blades includes a root, a tip, a leading edge between the root and the tip, and a trailing edge between the root and the tip. Each of the blades defines a blade radius between the blade tips and the central axis. Each of the blades defines a decreasing skew angle within the outer 20% of the blade radius. The ratio of blade pitch to average blade pitch increases from a lowest value to a highest value within the outer 20% of the blade radius. The highest value is about 30% to about 75% greater than the lowest value.

20 Claims, 9 Drawing Sheets

U.S. PATENT DOCUMENTS

| | | | | |
|---|---|---|---|---|
| 5,769,607 | A | 6/1998 | Neely et al. | |
| 5,906,179 | A | 5/1999 | Capdevila | |
| 5,961,289 | A | 10/1999 | Lohmann | |
| 6,065,937 | A | 5/2000 | Hunt | |
| 6,238,184 | B1 | 5/2001 | Giribaldi | |
| 6,241,474 | B1 | 6/2001 | Alizadeh et al. | |
| 6,287,078 | B1 | 9/2001 | Min et al. | |
| 6,350,104 | B1 | 2/2002 | Moreau et al. | |
| 6,368,061 | B1 | 4/2002 | Capdevila | |
| 6,375,427 | B1 | 4/2002 | Williams et al. | |
| 6,398,492 | B1 | 6/2002 | Cho et al. | |
| 6,554,574 | B1 | 4/2003 | Spaggiari | |
| 6,558,123 | B1 | 5/2003 | Spaggiari | |
| 6,579,063 | B2 | 6/2003 | Stairs et al. | |
| 6,595,744 | B2 | 7/2003 | Van Houten | |
| 6,872,052 | B2 | 3/2005 | Havel et al. | |
| 6,908,287 | B2 | 6/2005 | Cho et al. | |
| 7,189,061 | B2 * | 3/2007 | Hong et al. | 416/145 |
| 2003/0026699 | A1 | 2/2003 | Stairs et al. | |
| 2005/0249597 | A1 | 11/2005 | Havel et al. | |
| 2006/0067820 | A1 | 3/2006 | Wang et al. | |

FOREIGN PATENT DOCUMENTS

| | | | |
|---|---|---|---|
| GB | 2427899 | A | 1/2007 |
| WO | 9506822 | A1 | 3/1995 |
| WO | 2005066504 | | 7/2005 |
| WO | 2005098213 | A1 | 10/2005 |
| WO | 2005100797 | A1 | 10/2005 |
| WO | 2006006043 | A1 | 1/2006 |

* cited by examiner

AXIAL FAN ASSEMBLY

RELATED APPLICATIONS

This application claims priority to U.S. Provisional Patent Application No. 60/803,576 filed May 31, 2006, the entire content of which is hereby incorporated by reference.

FIELD OF THE INVENTION

The present invention relates to axial fans, and more particularly to automotive axial fan assemblies.

BACKGROUND OF THE INVENTION

Axial fan assemblies, when utilized in an automotive application, typically include a shroud, a motor coupled to the shroud, and an axial fan driven by the motor. The axial fan typically includes a band connecting the respective tips of the axial fan blades, thereby reinforcing the axial fan blades and allowing the tips of the blades to generate more pressure.

SUMMARY OF THE INVENTION

Axial fan assemblies utilized in automotive applications must operate with high efficiency and low noise. However, various constraints often complicate this design goal. Such constraints may include, for example, limited spacing between the axial fan and an upstream heat exchanger (i.e., "fan-to-core spacing"), aerodynamic blockage from engine components immediately downstream of the axial fan, a large ratio of the area of shroud coverage to the swept area of the axial fan blades (i.e., "area ratio"), and recirculation between the band of the axial fan and the shroud.

Several factors can contribute to decreasing the efficiency of the axial fan. A large area ratio combined with a small fan-to-core spacing usually results in relatively high inward radial inflow velocities near the tips of the axial fan blades. Airflow in this region also often mixes with a recirculating airflow around the band. Such a recirculating airflow around the band can have a relatively high degree of "pre-swirl," or a relatively high tangential velocity in the direction of rotation of the axial fan. These factors, considered individually or in combination, often decrease the ability of the tips of the axial fan blades to generate pressure efficiently.

The present invention provides, in one aspect, axial fan blades configured to maintain high velocity airflow attached to the tips of the axial fan blades and the band (i.e., in a region of the fan blades corresponding with the outer 20% of the radius of the fan blades) despite the presence of one or more of the above-listed factors that can contribute to decreasing the efficiency of the axial fan.

The present invention provides, in another aspect, an axial fan including a hub adapted for rotation about a central axis and a plurality of blades extending radially outwardly from the hub and arranged about the central axis. Each of the blades includes a root, a tip, a leading edge between the root and the tip, and a trailing edge between the root and the tip. Each of the blades defines a blade radius between the blade tips and the central axis. Each of the blades defines a decreasing skew angle within the outer 20% of the blade radius. A ratio of blade pitch to average blade pitch increases from a lowest value to a highest value within the outer 20% of the blade radius. The highest value is about 30% to about 75% greater than the lowest value.

The present invention provides, in yet another aspect, an axial fan assembly including a shroud and a motor coupled to the shroud. The motor includes an output shaft rotatable about a central axis. The axial fan assembly also includes an axial fan having a hub coupled to the output shaft for rotation about the central axis and a plurality of blades extending radially outwardly from the hub and arranged about the central axis. Each of the blades includes a root, a tip, a leading edge between the root and the tip, and a trailing edge between the root and the tip. Each of the blades defines a blade radius between the blade tips and the central axis. Each of the blades defines a decreasing skew angle within the outer 20% of the blade radius. A ratio of blade pitch to average blade pitch increases from a lowest value to a highest value within the outer 20% of the blade radius. The highest value is about 30% to about 75% greater than the lowest value.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
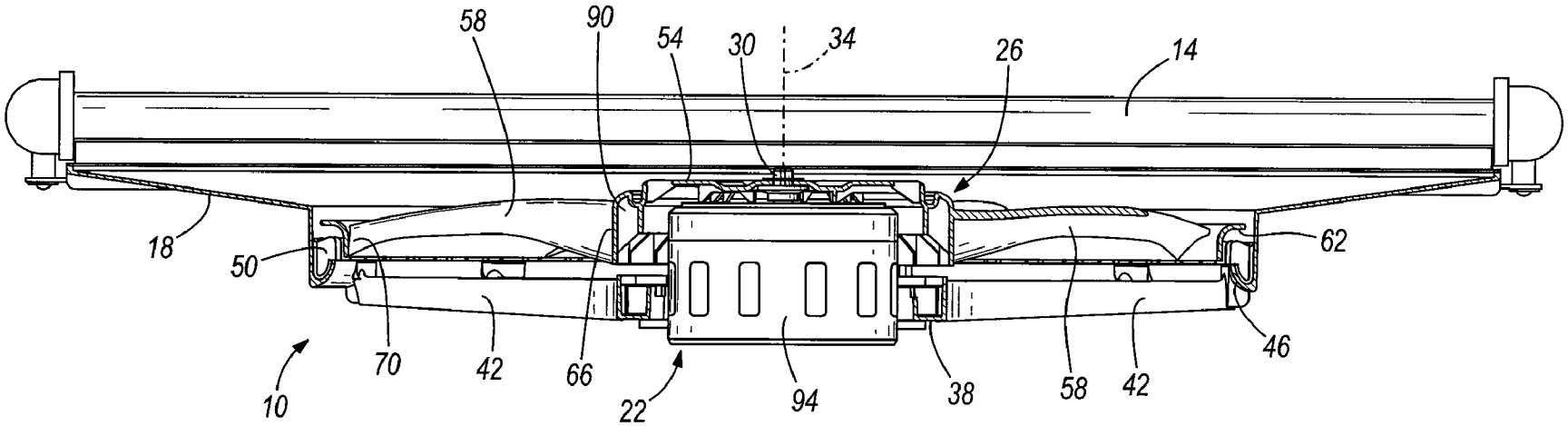
FIG. 1 is a partial cross-sectional view of an axial fan assembly of the present invention, illustrating a shroud, a motor coupled to the shroud, and an axial fan driven by the motor.
Figure 2:
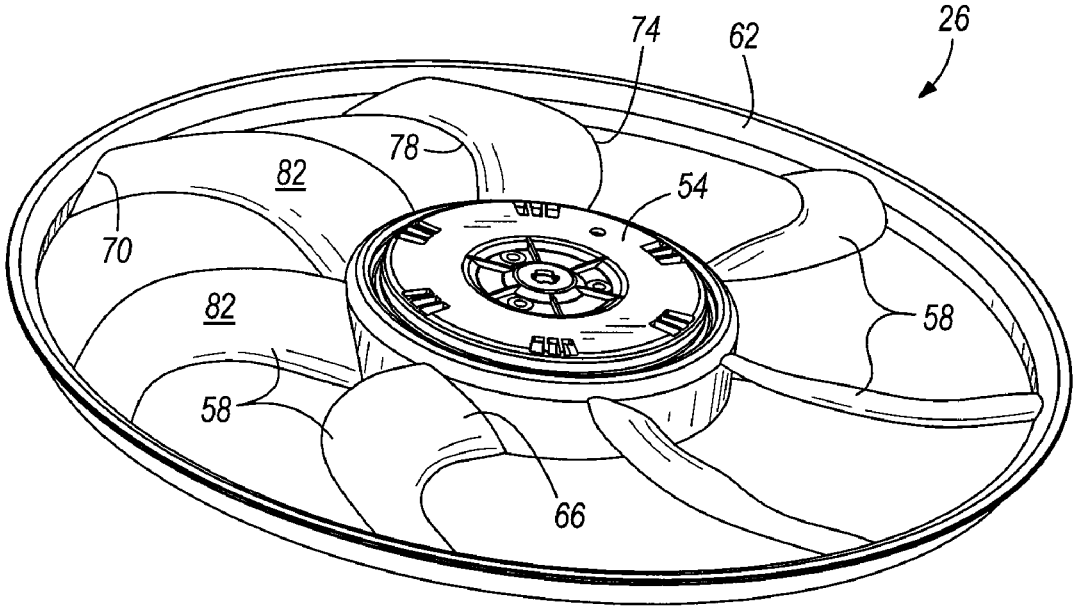
FIG. 2 is a top perspective view of the axial fan of the axial fan assembly of FIG. 1.

FIG. 1 illustrates an axial fan assembly 10 coupled to a heat exchanger 14, such as an automobile radiator. However, the axial fan assembly 10 may be utilized in combination with the heat exchanger 14 in any of a number of different applications. The axial fan assembly 10 includes a shroud 18, a motor 22 coupled to the shroud 18, and an axial fan 26 coupled to and driven by the motor 22. Particularly, as shown in FIG. 1, the motor 22 includes an output shaft 30 for driving the axial fan 26 about a central axis 34 of the output shaft 30 and the axial fan 26.

The axial fan assembly 10 is coupled to the heat exchanger 14 in a "draw-through" configuration, such that the axial fan 26 draws an airflow through the heat exchanger 14. Alternatively, the axial fan assembly 10 may be coupled to the heat exchanger 14 in a "push-through" configuration, such that the axial fan 10 discharges an airflow through the heat exchanger 14. Any of a number of different connectors may be utilized to couple the axial fan assembly 10 to the heat exchanger 14.

In the illustrated construction of the axial fan assembly 10 of FIG. 1, the shroud 18 includes a mount 38 upon which the motor 22 is coupled. The mount 38 is coupled to the outer portions of the shroud 18 by a plurality of canted vanes 42, which redirect the airflow discharged by the axial fan 26. However, an alternative construction of the axial fan assembly 10 may utilize other support members, which do not substantially redirect the airflow discharged from the axial fan 26, to couple the mount 38 to the outer portions of the shroud 18. The motor 22 may be coupled to the mount 38 using any of a number of different fasteners or other connecting devices.

The shroud 18 also includes a substantially annular outlet bell 46 positioned around the outer periphery of the axial fan 26. A plurality of leakage stators 50 are coupled to the outlet bell 46 and are arranged about the central axis 34. During operation of the axial fan 26, the leakage stators 50 reduce recirculation around the outer periphery of the axial fan 26 by disrupting or decreasing the tangential component of the recirculating airflow (i.e., the "pre-swirl"). However, an alternative construction of the axial fan assembly 10 may utilize an outlet bell 46 and leakage stators 50 configured differently than those illustrated in FIG. 1 Further, yet another alternative construction of the axial fan assembly 10 may not include the outlet bell 46 or leakage stators 50.

With reference to FIGS. 1-4, the axial fan 26 includes a central hub 54, a plurality of blades 58 extending outwardly from the hub 54, and a band 62 connecting the blades 58. Particularly, each blade 58 includes a root portion or a root 66 adjacent and coupled to the hub 54, and a tip portion or a tip 70 spaced outwardly from the root 66 and coupled to the band 62. The radial distance between the central axis 34 and the tips 70 of the respective blades 58 is defined as the maximum blade radius "R" of the axial fan 26 (see FIG. 4), while the radial distance between the root 66 of each blade 58 and the corresponding tip 70 of each blade 58 is defined as the span of the blade "S." The diameter of the blades 58 is defined as the maximum blade diameter "D" and is equal to two times the blade radius "R."

Each blade 58 also includes a leading edge 74 between the root 66 and the tip 70, and a trailing edge 78 between the root 66 and the tip 70. FIG. 4 illustrates the leading and trailing edges 74, 78 of the blades 58 relative to the clockwise-direction of rotation of the axial fan 26, indicated by arrow "A." In an alternative construction of the axial fan assembly 10, the blades 58 may be configured differently in accordance with a counter-clockwise direction of rotation of the axial fan 26. Further, each blade 58 includes a pressure surface 86 (see FIGS. 2 and 4) and a suction surface 82 (see FIG. 3). The pressure and suction surfaces 86, 82 give each blade 58 an airfoil shape, which allows the axial fan 26 to generate an airflow.

Figure 3:
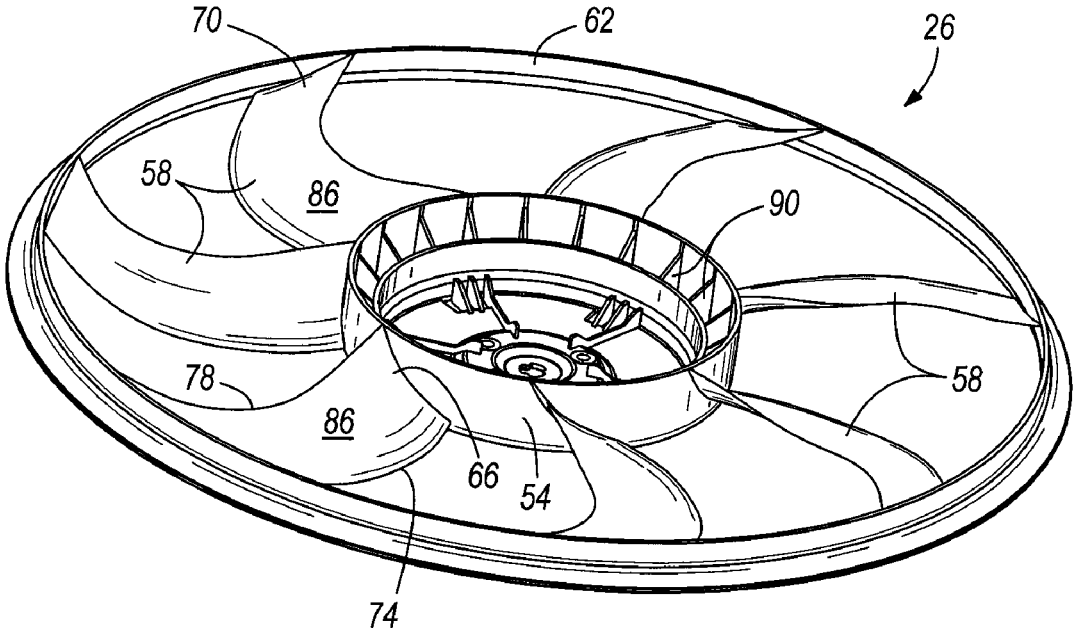
FIG. 3 is a bottom perspective view of the axial fan of the axial fan assembly of FIG. 1.
Figure 4:
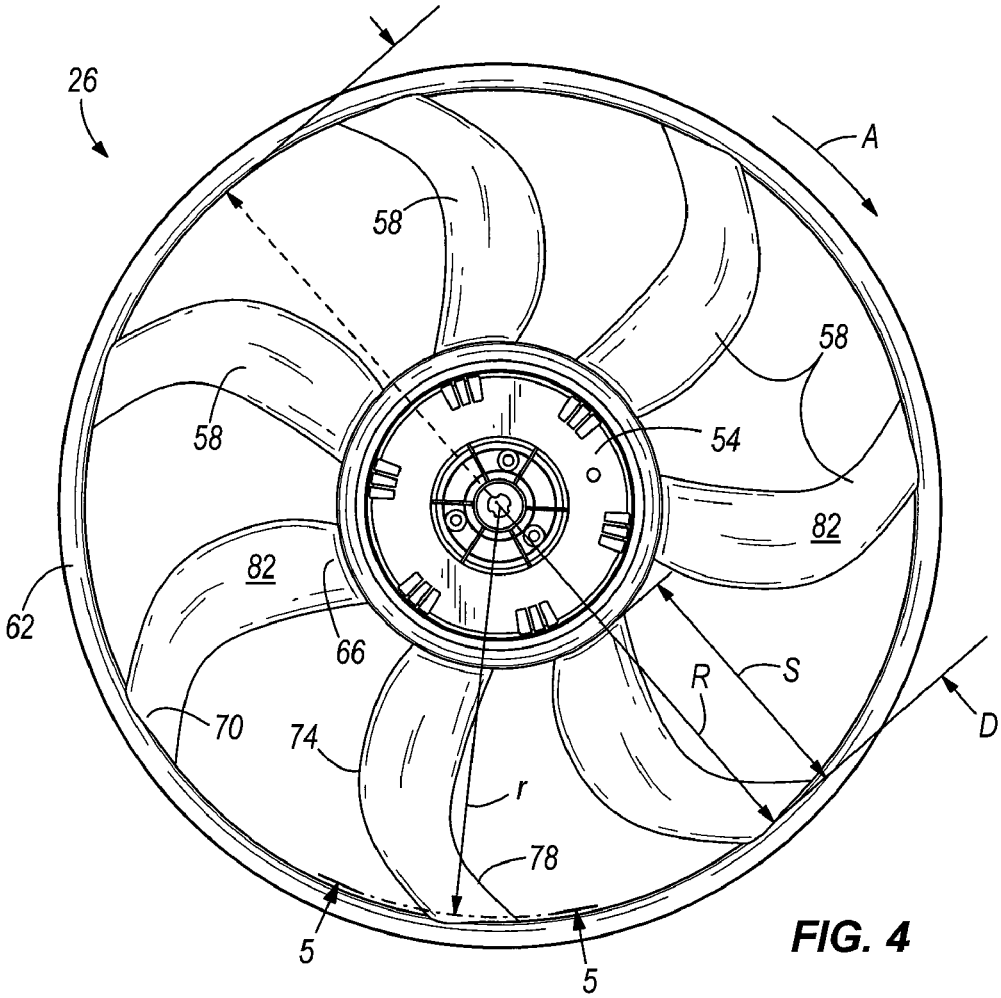
FIG. 4 is a top view of the axial fan of the axial fan assembly of FIG. 1.

With reference to FIGS. 1 and 3, a plurality of secondary blades 90 are arranged about the central axis 34 and coupled to the inner periphery of the hub 54 to provide a cooling airflow over the motor 22. The motor 22 may include a motor housing 94 substantially enclosing the electrical components of the motor (see FIG. 1). Although not shown in FIG. 1, the motor housing 94 may include a plurality of apertures to allow the cooling airflow generated by the secondary blades 90 to pass through the housing 94 to cool the electrical components of the motor 22. Alternatively, the motor housing 94 may not include any apertures, and the cooling airflow generated by the secondary blades 90 may be directed solely over the housing 94. In yet another construction of the axial fan assembly 10, the axial fan 26 may not include the secondary blades 90.

With reference to FIG. 4, several characteristics of the blades 58 vary over the span S. Particularly, these characteristics may be measured at discrete cylindrical blade sections corresponding with a radius "r" moving from the root 66 of the blade 58 to the tip 70 of the blade 58. A blade section having radius "r" is thus defined at the intersection of the fan 26 with a cylinder having radius "r" and an axis colinear with the central axis 34 of the fan 26. As previously discussed, the blade section corresponding with the tip 70 of the blade 58 has a radius "R" equal to the maximum radius of the blades 58 of the axial fan 26. Therefore, characteristics of the blades 58 which vary over the span S can be described with reference to a particular blade section at a fraction (i.e., "r/R") of the blade radius R. As used herein, the fraction "r/R" may also be referred to as the "non-dimensional radius."

Figure 5:
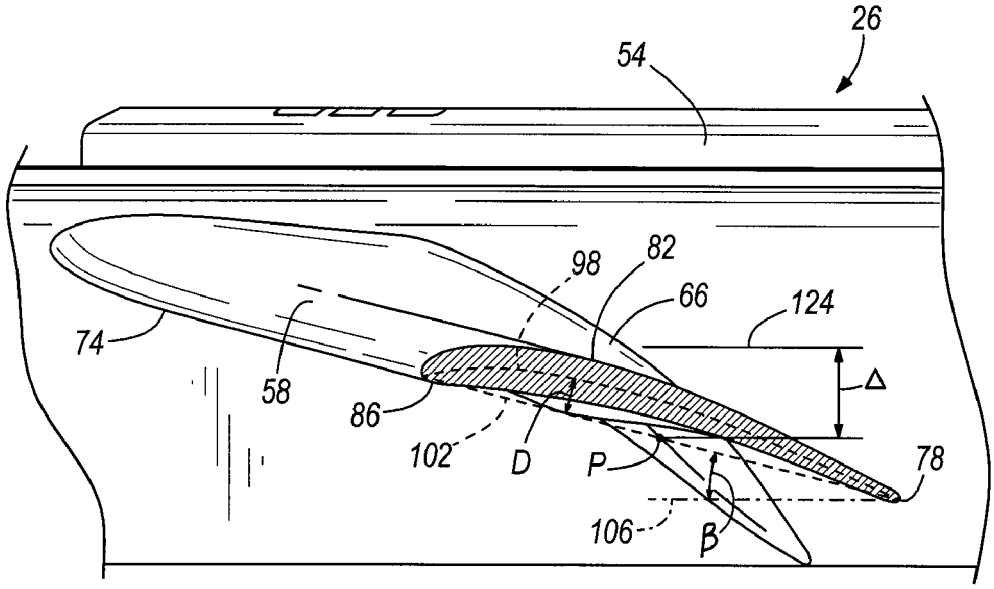
FIG. 5 is an enlarged, cross-sectional view of the axial fan along line 5-5 in FIG. 4.

With reference to FIG. 5, a blade section near the end of the span S (i.e., r/R~1) is shown. At this particular blade section, the blade 58 has a curvature. The extent of the curvature of the blade 58, otherwise known in the art as "camber," is measured by referencing a mean line 98 and a nose-tail line 102 of the blade 58 at the particular blade section. As shown in FIG. 5, the mean line 98 extends from the leading edge 74 to the trailing edge 78 of the blade 58, half-way between the pressure surface 86 and the suction surface 82 of the blade 58. The nose-tail line 102 is a straight line extending between the leading edge 74 and the trailing edge 78 of the blade 58, and intersecting the mean line 98 at the leading edge 74 and the trailing edge 78 of the blade 58.

Camber is a non-dimensional quantity that is a function of position along the nose-tail line 102. Particularly, camber is a function describing the perpendicular distance "D" from the nose-tail line 102 to the mean line 98, divided by the length of the nose-tail line 102, otherwise known as the blade "chord." Generally, the larger the non-dimensional quantity of camber, the greater the curvature of the blade 58.

FIG. 5 also illustrates, at the blade section near the end of the span S (i.e., r/R~1), a pitch angle "β" of the blade 58. The pitch angle β is defined as the angle between the nose-tail line 102 and a plane 106 substantially normal to the central axis 34. Knowing the pitch angle β of the blade 58 corresponding with each subsequent blade section at radius "r," moving from the root 66 of the blade 58 to the tip 70 of the blade 58, the blade's "pitch" may be calculated with the equation:

$$\text{Pitch}=2\pi r \tan \beta$$

The pitch of the blades 58 is a characteristic that generally governs the amount of static pressure generated by the blade 58 along its radial length. As is evident from the above equation, pitch is a dimensional quantity and is visualized as the axial distance theoretically traveled by the particular blade section at radius "r" through one shaft revolution, if rotating in a solid medium, akin to screw being threaded into a piece of wood.

Figure 9:
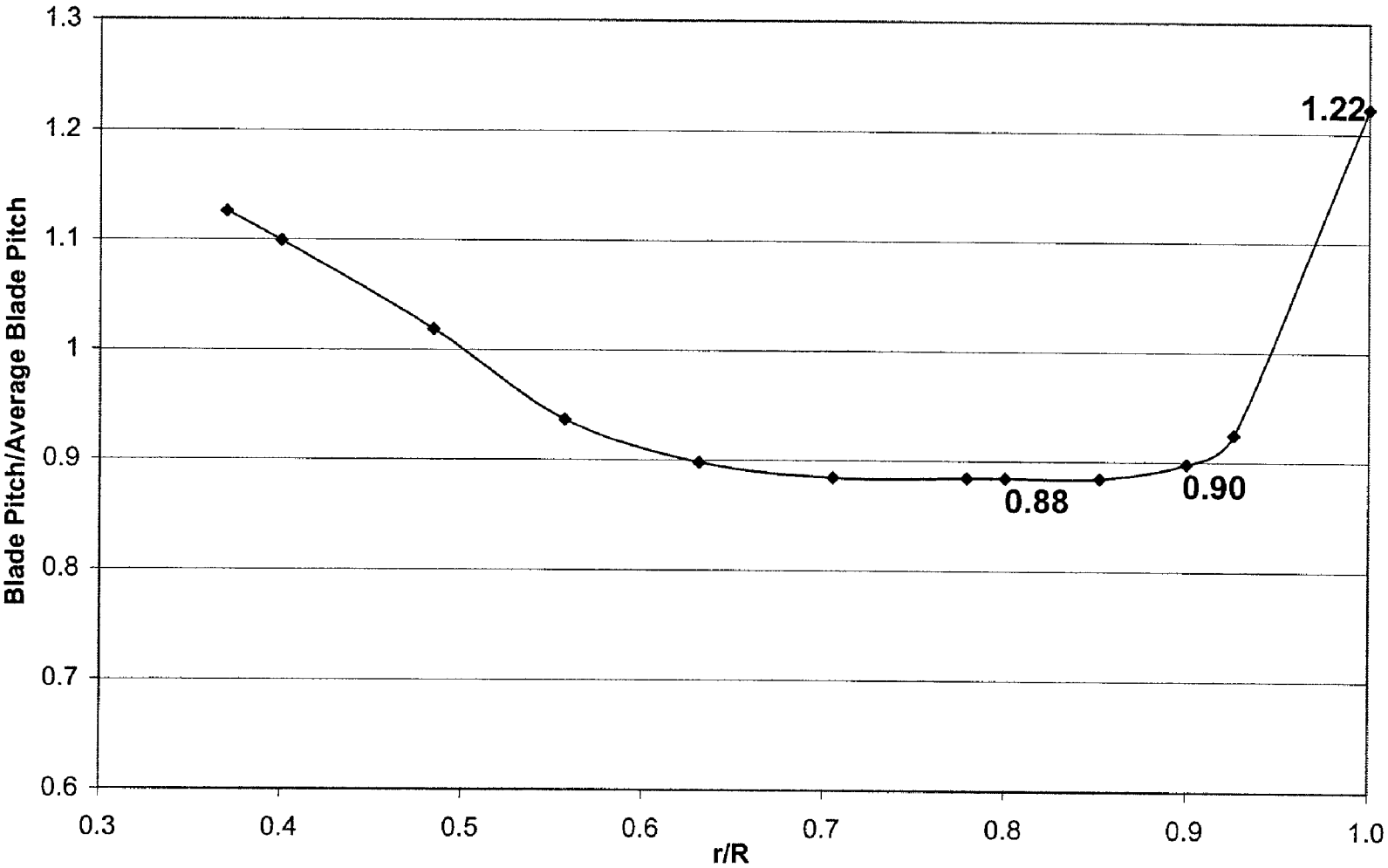
FIG. 9 is a graph illustrating blade pitch over the span of the axial fan of the axial fan assembly of FIG. 1.

FIG. 9 illustrates blade pitch over the span S of the axial fan 26. Particularly, the X-axis represents the fraction "r/R" along the span S of a particular blade section, and the Y-axis represents a ratio of blade pitch to the average blade pitch of all the blade sections between the root 66 of the blade 58 and the tip 70 of the blade 58. By taking the ratio of blade pitch to the average blade pitch, the curve illustrated in FIG. 9 is normalized and is representative of both high-pitch and low-pitch axial fans 26. In addition, the curve illustrated in FIG. 9 is representative of axial fans 26 having different blade diameters D. Because the "average blade pitch" is merely a scalar, the shape of the curve representative of "blade pitch" is the same as that which is representative of "blade pitch/average blade pitch."

With continued reference to FIG. 9, the ratio of blade pitch to average blade pitch does not decrease within the outer 20% of the blade radius R, or between $0.8 \leqq r/R \leqq 1$. Additionally, the ratio of blade pitch to average blade pitch increases within the outer 20% of the blade radius R. In the construction of the blade 58 represented by the curve of FIG. 9, the "blade pitch/average blade pitch" value increases by about 40% within the outer 20% of the blade radius R, from about 0.88 to about 1.22. However, in other constructions of the blade 58 the "blade pitch/average blade pitch" value may increase by at least about 5% within the outer 20% of the blade radius R. In addition, in the construction of the blade 58 represented by the curve of FIG. 9, the "blade pitch/average blade pitch" value increases continuously over the outer 10% of the blade radius R, or between $0.9 \leqq r/R \leqq 1$. In other constructions of the blade 58, the "blade pitch/average blade pitch" value may increase by about 30% to about 75% within the outer 20% of the blade radius R, while in yet other constructions of the blade 58 the "blade pitch/average blade pitch" value may increase by about 20% to about 60% within the outer 10% of the blade radius R.

By increasing the pitch of the blades 58 within the outer 20% of the blade radius R, as illustrated in FIG. 9, the tips 70 of the blades 58 can develop an increasing static pressure to maintain high-velocity axial airflow at the band 62, therefore improving efficiency of the axial fan 26, despite the presence of radially-inward components of the inflow.

Figure 6:
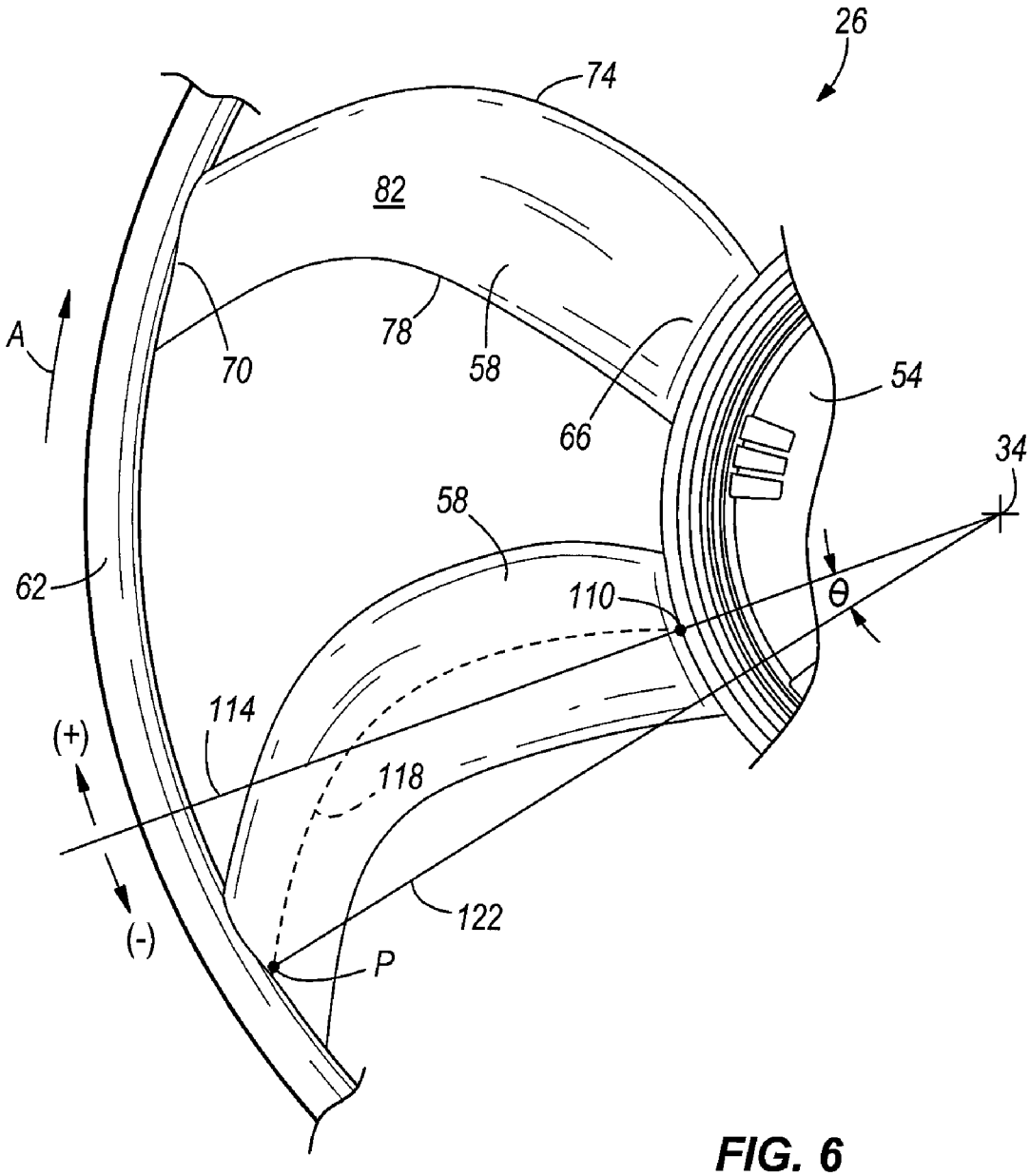
FIG. 6 is an enlarged, top view of a portion of the axial fan of the axial fan assembly of FIG. 1

With reference to FIG. 6, the blades 58 of the axial fan 26 are shaped having a varying skew angle "θ." The skew angle θ of the blade 58 is measured at a particular blade section corresponding with radius "r," with reference to the blade section corresponding with the root 66 of the blade 58. Specifically, a reference point 110 is marked mid-chord of the blade section corresponding with the root 66 of the blade 58, and a reference line 114 is drawn through the reference point 110 and the central axis 34 of the axial fan 26. As shown in FIG. 6, the reference line 114 demarcates a "positive" skew angle θ from a "negative" skew angle θ. As defined herein, a positive skew angle θ indicates that the blade 58 is skewed in the direction of rotation of the axial fan 26, while a negative skew angle θ indicates that the blade 58 is skewed in an opposite direction as the direction of rotation of the axial fan 26.

A mid-chord line 118 is then drawn between the leading edge 74 and trailing edge 78 of the blade 58. Each subsequent blade section corresponding with an increasing radius "r" has a mid-chord point (e.g., point "P" on the blade section illustrated in FIG. 5) that lies on the mid-chord line 118. The skew angle θ of the blade 58 at a particular blade section corresponding with radius "r" is measured between the reference line 114 and a line 122 connecting the mid-chord point of the particular blade section (e.g., point "P") and the central axis 34. As shown in FIG. 6, a portion of the blade 58 is skewed in the positive direction, and a portion of the blade 58 is skewed in the negative direction.

Figure 10:
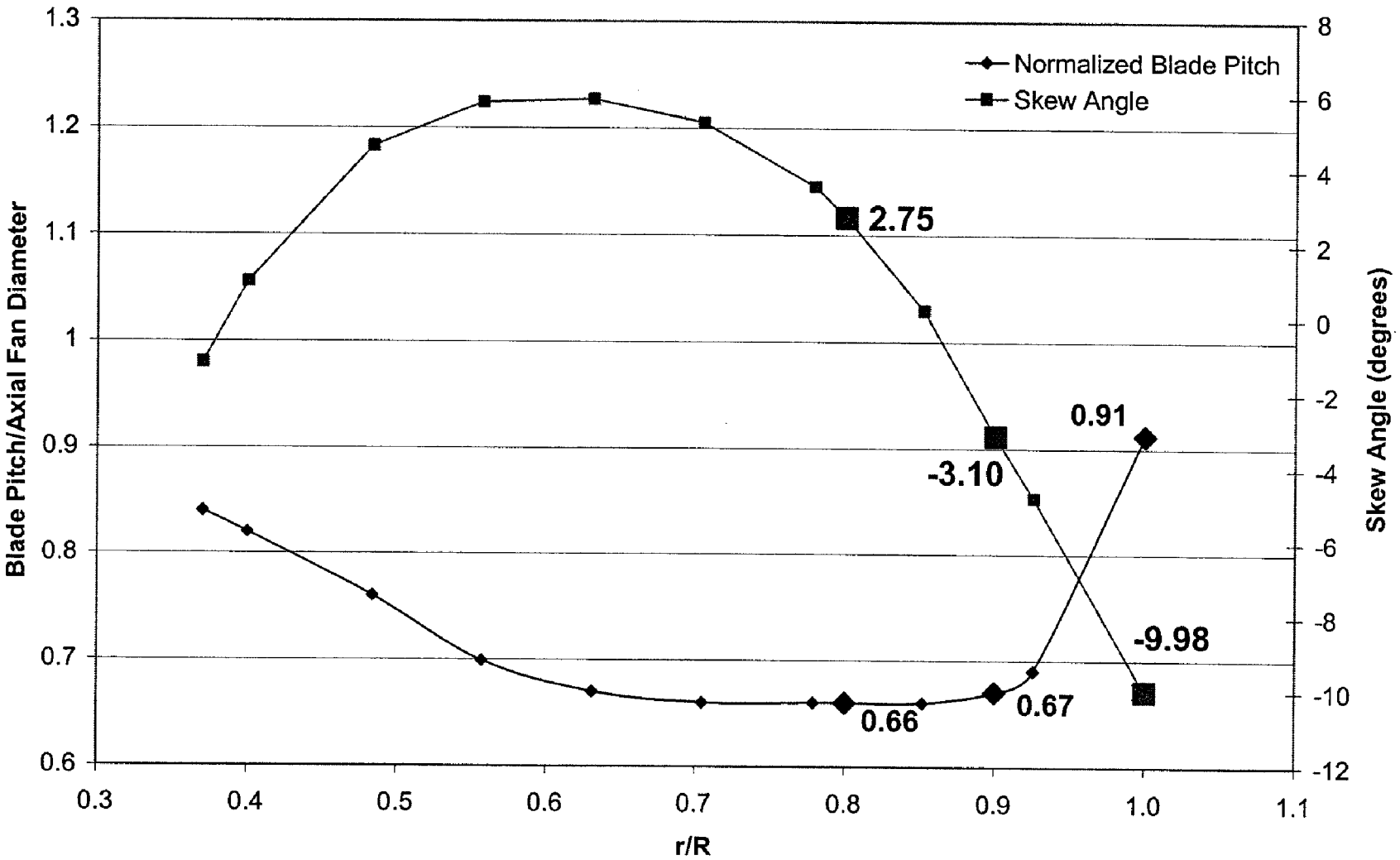
FIG. 10 is a graph illustrating blade pitch and blade skew angle over the span of the axial fan of the axial fan assembly of FIG. 1.

FIG. 10 illustrates blade pitch and skew angle θ over the span S of the axial fan 26. Particularly, the X-axis represents the non-dimensional radius, or the fraction "r/R," along the span S of a particular blade section, the left side Y-axis represents a ratio of blade pitch to the axial fan diameter or blade diameter D, and the right side Y-axis represents the skew angle θ with reference to the reference line 114. By taking the ratio of blade pitch to blade diameter D, the curve illustrated in FIG. 10 is non-dimensional and is representative of axial fans 26 having different blade diameters D. Because the blade diameter D is merely a scalar, the shape of the curve representative of "blade pitch" is the same as that which is representative of "blade pitch/blade diameter D."

With continued reference to FIG. 10, the blades 58 define a decreasing skew angle θ within the outer 20% of the blade radius R. In other words, the skew angle θ decreases within the range $0.8 \leqq r/R \leqq 1$. Further, the skew angle θ of the blades 58 continuously decreases over the outer 20% of the blade radius R. In the construction of the blade 58 represented by the curve of FIG. 10, the skew angle θ decreases by about 12.75 degrees within the outer 20% of the blade radius R, from about (+)2.75 degrees to about (−)9.98 degrees. Alternatively, the blades 58 may be configured such that the skew angle θ decreases more or less than about 12.75 degrees within the outer 20% of the blade radius R. However, in a preferred construction of the fan 26, the skew angle θ of the blades 58 should decrease by at least about 5 degrees within the outer 20% of the blade radius R.

Figure 11:
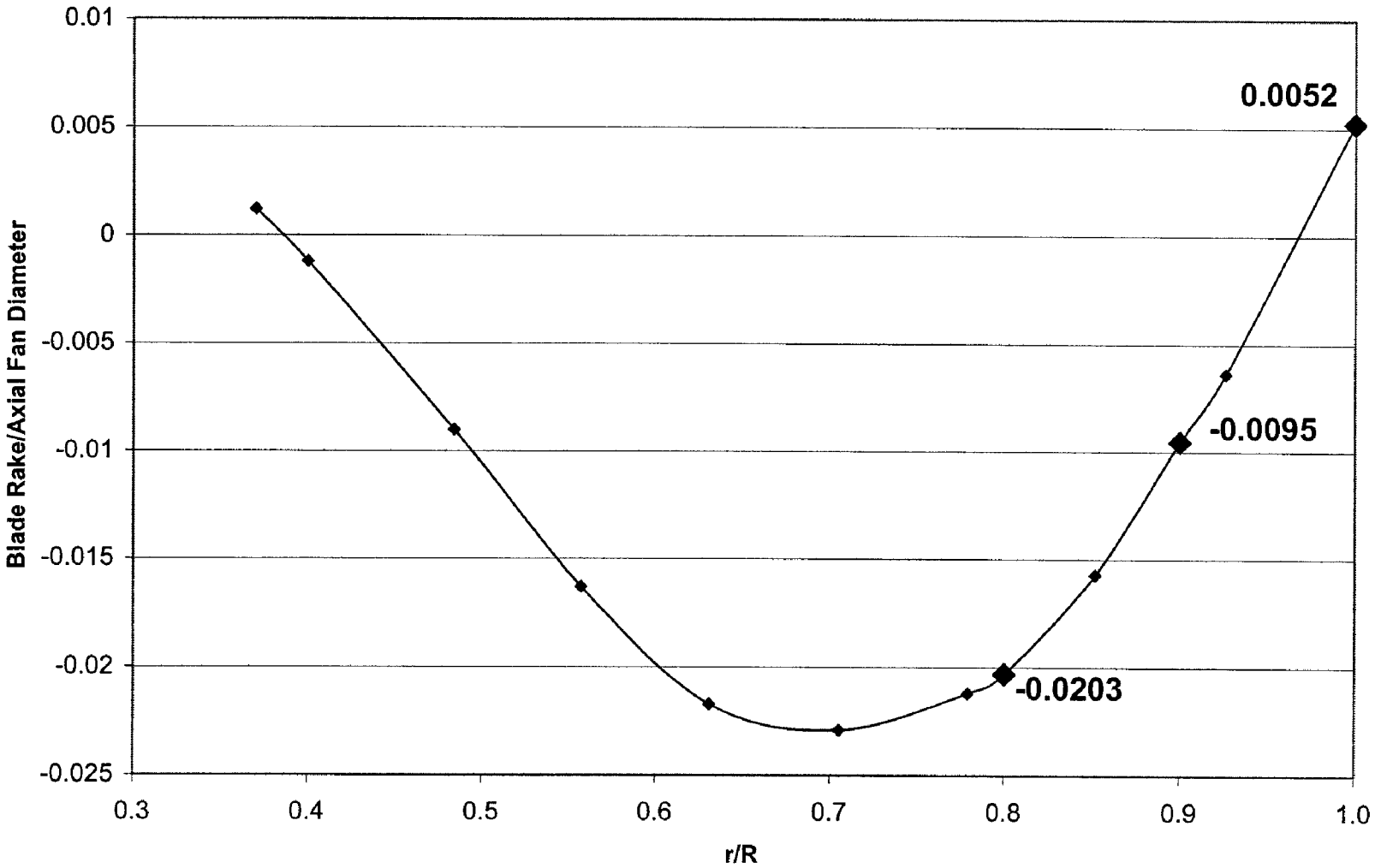
FIG. 11 is a graph illustrating blade rake over the span of the axial fan of the axial fan assembly of FIG. 1.

With reference to FIGS. 5 and 11, the blades 58 of the axial fan 26 are shaped having a varying rake profile. As shown in FIG. 5, blade rake is measured as an axial offset "Δ" of a mid-chord point (e.g., point "P") of a particular blade section corresponding with radius "r" with reference to a mid-chord point of the blade section corresponding with the root 66 of the blade 58 (approximated by reference line 124). The value of the axial offset Δ is negative when the mid-chord point (e.g., point "P") of the blade section corresponding with radius "r" is located upstream of the mid-chord point of the blade section corresponding with the root 66 of the blade 58, while the value of the axial offset A is positive when the mid-chord point of the blade section corresponding with radius "r" is located downstream of the mid-chord point of the blade section corresponding with the root 66 of the blade 58.

FIG. 11 illustrates blade rake over the span S of the axial fan 26. Particularly, the X-axis represents the non-dimensional radius, or the fraction "r/R," along the span S of a particular blade section, and the Y-axis represents a ratio of blade rake to the axial fan diameter or blade diameter D. By taking the ratio of blade rake to blade diameter D (i.e., "non-dimensional blade rake"), the curve illustrated in FIG. 11 is non-dimensional and is representative of axial fans 26 having different blade diameters D. Because the blade diameter D is merely a scalar, the shape of the curve representative of "blade rake" is the same as that which is representative of "blade rake/blade diameter D."

The rake profile of the blades 58 over the outer 20% of the blade radius R is adjusted according to the skew angle and pitch profiles, illustrated in FIG. 10, to reduce the radially-inward and radially-outward components of surface normals extending from the pressure surface 86 of the blades 58. In other words, forward-skewing the blades 58 (i.e., in the positive direction indicated in FIG. 6) without varying the rake profile of the blades 58 yields surface normals, or rays extending perpendicularly from the pressure surface 86 of the blade 58, having radially-inward components in addition to axial and tangential components. Likewise, backward-skewing the blades 58 (i.e., in the negative direction indicated in FIG. 6) yields surface normals having radially-outward components in addition to axial and tangential components. Such radially-inward and radially-outward components of surface normals extending from the pressure surface 86 of the blades 58 can reduce the efficiency of the axial fan 26. However, by varying the rake profile of the blades 58 as shown in FIG. 11, such radially-inward and radially-outward components of the surface normals can be reduced, therefore increasing the efficiency of the axial fan 26 as well as the structural stability of the blades 58, and insuring that the pressure developed by each blade 58 is optimally aligned with the direction of airflow.

FIG. 11 illustrates one non-dimensional rake profile over the outer 20% of the blade radius R. Particularly, in the illustrated rake profile, the non-dimensional blade rake increases continuously over the outer 20% of the blade radius R. Further, in the illustrated rake profile, the rate of change of non-dimensional blade rake with respect to non-dimensional radius over the outer 20% of the blade radius R is about 0.08 to about 0.18. The illustrated rake profile over the outer 20% of the blade radius R can be described as a function of pitch change and skew angle change over the outer 20% of the blade radius R by the following formulae, in which "D" is equal to the blade diameter D:

$$\frac{Rake_{100\%} - Rake_{90\%}}{D} = \left(\frac{Skew_{90\%} - Skew_{100\%}}{360^\circ} \times \frac{Pitch_{100\%} + Pitch_{90\%}}{D \times 2}\right) \pm 0.004$$

$$\frac{Rake_{90\%} - Rake_{80\%}}{D} = \left(\frac{Skew_{80\%} - Skew_{90\%}}{360^\circ} \times \frac{Pitch_{90\%} + Pitch_{80\%}}{D \times 2}\right) \pm 0.004$$

To calculate the change in rake over the respective increments of the span S (i.e., $0.8 \leqq r/R \leqq 0.9$ and $0.9 \leqq r/R \leqq 1$), for an axial fan 26 of known blade diameter D, the respective values for pitch and skew first need to be determined empirically. Then, the values for change in rake can be calculated.

In alternative constructions of the axial fan 26, the blades 58 may include different skew angle and pitch profiles over the outer 20% of the blade radius R, such that the resulting rake profile over the outer 20% of the blade radius R is different than the illustrated non-dimensional rake profile in FIG. 11.

Figure 7:
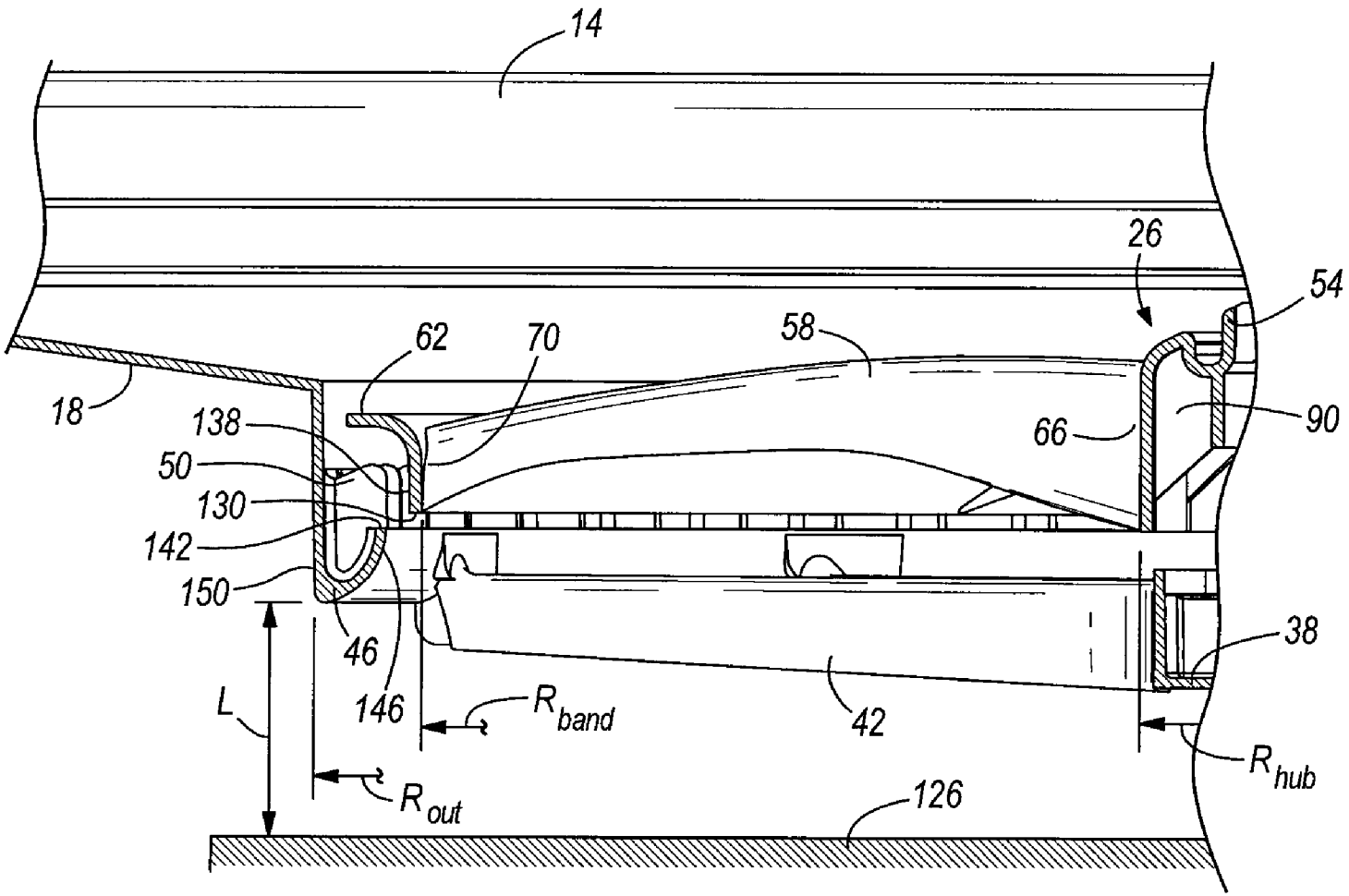
FIG. 7 is an enlarged, cross-sectional view of a portion of the axial fan assembly of FIG. 1, illustrating a downstream blockage spaced from the axial fan.

With reference to FIG. 7, the axial fan assembly 10 is shown positioned relative to a schematically-illustrated downstream "blockage" 126. Such a blockage 126 may be a portion of the automobile engine, for example. The efficiency of the axial fan assembly 10 is dependent in part upon the spacing of the band 62 from the outlet bell 46 and the leakage stators 50, and upon the spacing between the outlet bell 46 and the blockage 126.

Figure 8:
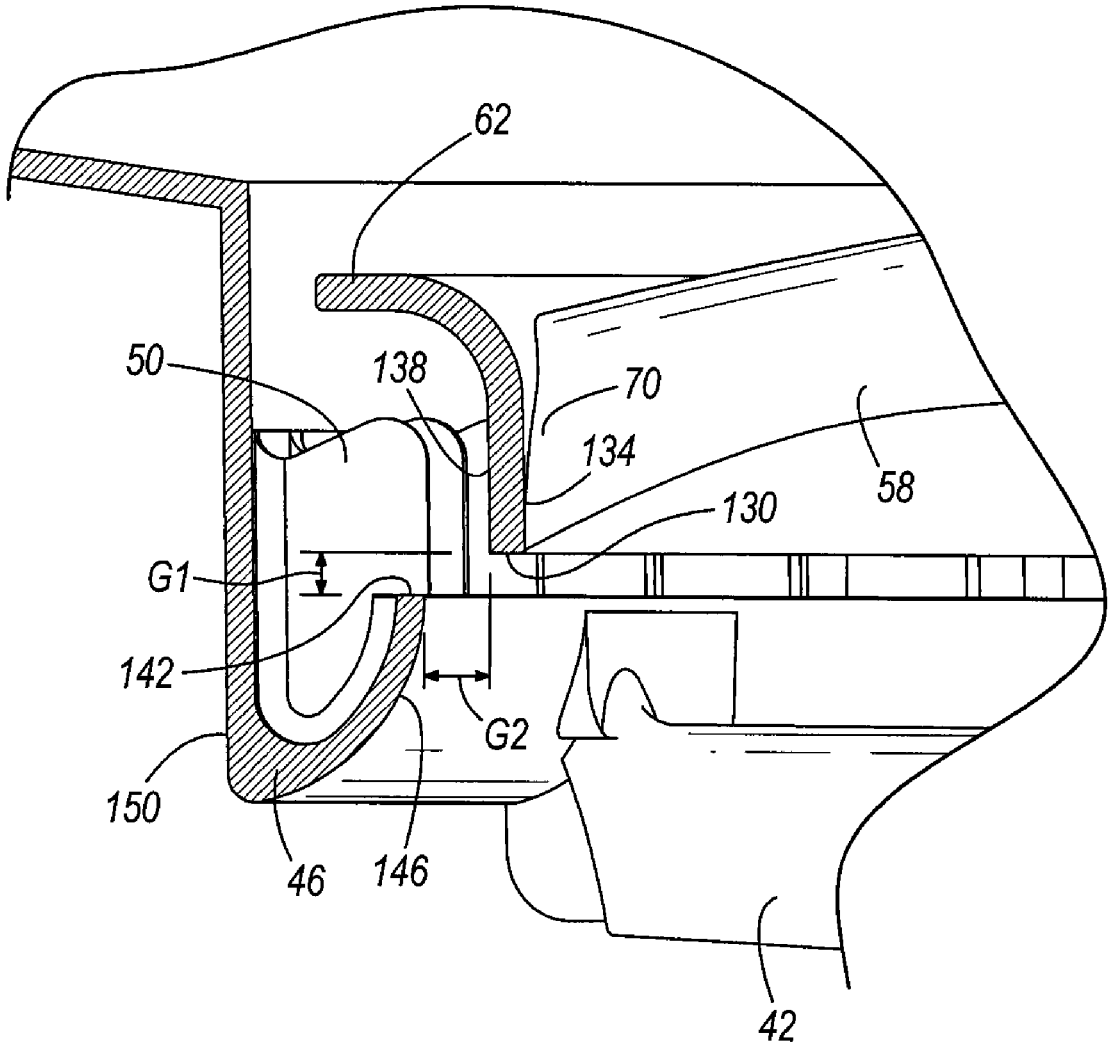
FIG. 8 is an enlarged view of the cross-section of the axial fan assembly of FIG. 7, illustrating the spacing between the axial fan and the shroud.

FIG. 8 illustrates the spacing between the band 62 and the outlet bell 46 and the leakage stators 50 in one construction of the axial fan assembly 10. Particularly, the band 62 includes an end surface 130 adjacent an axially-extending, radially-innermost surface 134 and an axially-extending, radially-outermost surface 138. The outlet bell 46 includes an end surface 142 adjacent a radially-innermost surface 146. An axial gap "G1" is measured between the respective end surfaces 130, 142 of the band 62 and the outlet bell 46. FIG. 8 also illustrates a radial gap "G2" measured between the axially-extending, radially-outermost surface 138 of the band 62 and the radially-innermost surface 146 of the outlet bell 46.

The axial gap G1 and the radial gap G2 are determined with respect to the spacing ("L") between the outlet bell 46 and the blockage 126 (see FIG. 7), the radius of the axially-extending, radially-innermost surface 134 of the band ("$R_{band}$"), the radius of the hub 54 ("$R_{hub}$"), and the radius of a radially-outermost surface of the outlet bell 150 ("$R_{out}$"). Particularly, the axial gap G1 and the radial gap G2 may be determined with respect to a "Blockage Factor" calculated according to the formula:

$$BlockageFactor = \frac{R_{band}^2 - R_{hub}^2}{2 \times L \times R_{out}}$$

With reference to FIG. 8, in a construction of the axial fan assembly 10 in which the Blockage Factor is less than about 0.83, a ratio of the axial gap G1 to the blade diameter D may be about 0.01 to about 0.025. However, in a construction of the axial fan assembly 10 in which the Blockage Factor is greater than or equal to about 0.83, the ratio of the axial gap G1 to blade diameter D may be about 0 to about 0.01. In the axial fan assembly 10 illustrated in FIG. 8, the axial gap G1 is formed by positioning the end surface 130 upstream of the end surface 142. However, when the Blockage Factor is greater than or equal to about 0.83, the axial gap G1 may be formed by positioning the end surface 130 downstream of the end surface 142. These preferred axial gaps G1, in combination with the preferred profiles for pitch, skew angle θ, and axial offset Δ (i.e., rake) illustrated in FIGS. 9-11, can increase the overall efficiency of the axial fan assembly 10 by increasing the efficiency of the leakage stators 50, while reducing pre-swirl and recirculation of the airflow between the band 62 and the outlet bell 46.

With continued reference to FIG. 8, in a construction of the axial fan assembly 10 in which the Blockage Factor is greater than or equal to about 0.83, a ratio of the radial gap G2 to blade diameter D may be about 0.01 to about 0.02. In the axial fan assembly 10 illustrated in FIG. 8, the radial gap G2 is formed by positioning the axially-extending, radially-outermost surface 138 radially inwardly of the radially-innermost surface 146 of the outlet bell 46. However, when the Blockage Factor is less than about 0.83, the radial gap G2 may be formed by positioning the axially-extending, radially-outermost surface 138 radially outwardly of the radially-innermost surface 146 of the outlet bell 46.

In a construction of the axial fan assembly 10 in which the Blockage Factor is less than about 0.83, the axially-extending, radially-innermost surface 134 is substantially aligned with the radially-innermost surface 146 of the outlet bell 46. Therefore, a ratio of the radial gap G2 to blade diameter D may be about 0 to about 0.01. In such a construction of the axial fan assembly 10, the leakage stators 50 may be configured to provide sufficient clearance for the band 62. These preferred radial gaps G2, in combination with the preferred profiles for pitch, skew angle θ, and axial offset Δ (i.e., rake) illustrated in FIGS. 9-11, can increase the overall efficiency of the axial fan assembly 10 by reducing wake separation and unnecessary constriction.

The axial fan assembly 10 incorporates a relatively constant static pressure rise over the span of the axial fan blades 58 with a large shroud area ratio and small fan-to-core spacing. This combination of features often yields relatively high inward-radial inflow velocities at the tips 70 of the fan blades 58. Additionally, a relatively high static pressure rise near the tips 70 of the blades 58 increases the recirculation of airflow between the band 62 and the outlet bell 46. This, in turn, increases the pre-swirl of the inflow to the tips 70 of the blades 58. Relatively high radially-inward inflow velocities can lead to separation of airflow from the band 62 and outlet bell 46. Increasing the pitch of the blades 58 within the outer 20% of the blade radius R adapts the tips 70 of the blades 58 to the relatively high inflow velocities. The resulting increase in inflow velocities and static pressure rise is sustained by raking the blades 58 within the outer 20% of the blade radius R to insure that pressure developed by the blades 58 is optimally aligned with the direction of airflow, radially spacing the band 62 and the outlet bell 46 within a particular range depending on the Blockage Factor to guard against wake-separation and unnecessary constriction, and axially spacing the band 62 and the outlet bell 46 within a particular range depending on the Blockage Factor to optimize the function of the leakage stators 50 to reduce pre-swirl and recirculation.

Various features of the invention are set forth in the following claims.

What is claimed is:

1. An axial fan comprising:

a hub adapted for rotation about a central axis;

a plurality of blades extending radially outwardly from the hub and arranged about the central axis, each of the blades including a root;

a tip;

a leading edge between the root and the tip; and a trailing edge between the root and the tip;

wherein each of the blades defines a blade radius between the blade tips and the central axis;

wherein each of the blades defines a decreasing skew angle within the outer 20% of the blade radius;

wherein a ratio of blade pitch to average blade pitch generally increases in a radial direction from a lowest value within the outer 20% of the blade radius to a highest value within the outer 20% of the blade radius; and wherein the highest value is about 30% to about 75% greater than the lowest value.

2. The axial fan of claim 1, wherein the ratio of blade pitch to average blade pitch increases from a lowest value within the outer 10% of the blade radius to a highest value within the outer 10% of the blade radius, and wherein the highest value within the outer 10% of the blade radius is about 20% to about 60% greater than the lowest value within the outer 10% of the blade radius.

3. The axial fan of claim 1, wherein the skew angle of the blades continuously decreases over the outer 20% of the blade radius.

4. The axial fan of claim 1, wherein each of the blades defines an increasing rake within the outer 20% of the blade radius.

5. The axial fan of claim 4, wherein the rake increases continuously over the outer 20% of the blade radius.

6. The axial fan of claim 4, wherein a ratio of rake to maximum blade diameter comprises a non-dimensional blade rake, and wherein a rate of change of the non-dimensional blade rake with respect to a non-dimensional radius over the outer 20% of the blade radius is about 0.08 to about 0.18.

7. The axial fan of claim 1, wherein the ratio of blade pitch to average blade pitch does not decrease within the outer 20% of the blade radius.

8. An axial fan assembly comprising:

a shroud;

a motor coupled to the shroud, the motor including an output shaft rotatable about a central axis;

an axial fan including a hub coupled to the output shaft for rotation about the central axis;

a plurality of blades extending radially outwardly from the hub and arranged about the central axis, each of the blades including a root;

a tip;

a leading edge between the root and the tip; and a trailing edge between the root and the tip;

wherein each of the blades defines a blade radius between the blade tips and the central axis;

wherein each of the blades defines a decreasing skew angle within the outer 20% of the blade radius;

wherein a ratio of blade pitch to average blade pitch generally increases in a radial direction from a lowest value within the outer 20% of the blade radius to a highest value within the outer 20% of the blade radius; and wherein the highest value is about 30% to about 75% greater than the lowest value.

9. The axial fan assembly of claim 8, wherein the ratio of blade pitch to average blade pitch increases from a lowest value within the outer 10% of the blade radius to a highest value within the outer 10% of the blade radius, and wherein the highest value within the outer 10% of the blade radius is about 20% to about 60% greater than the lowest value within the outer 10% of the blade radius.

10. The axial fan assembly of claim 8, wherein the skew angle of the blades continuously decreases over the outer 20% of the blade radius.

11. The axial fan assembly of claim 8, wherein each of the blades defines an increasing rake within the outer 20% of the blade radius.

12. The axial fan assembly of claim 11, wherein the rake increases continuously over the outer 20% of the blade radius.

13. The axial fan assembly of claim 11, wherein a ratio of rake to maximum blade diameter comprises a non-dimensional blade rake, wherein a rate of change of the non-dimensional blade rake with respect to a non-dimensional radius over the outer 20% of the blade radius is about 0.08 to about 0.18.

14. The axial fan assembly of claim 8, wherein the fan includes a substantially circular band coupled to the tips of the blades, and wherein the shroud includes a substantially annular outlet bell centered on the central axis.

15. The axial fan assembly of claim 14, further comprising a plurality of leakage stators positioned radially outwardly from the band and adjacent the outlet bell, wherein the leakage stators are arranged about the central axis.

16. The axial fan assembly of claim 15, wherein the outlet bell includes a radially-innermost surface, a radially-outermost surface, and an end surface adjacent the radially-innermost surface, wherein the leakage stators are positioned between the radially-innermost surface and the radially-outermost surface, wherein the band includes an axially-extending, radially-innermost surface, an axially-extending, radially-outermost surface, and an end surface adjacent the axially-extending, radially-innermost surface and the axially-extending, radially-outermost surface, wherein the respective end surfaces of the band and the outlet bell are spaced by an axial gap, and wherein a ratio of the axial gap to a maximum blade diameter is about 0 to about 0.01, wherein the axially-extending, radially-outermost surface of the band is spaced radially inwardly of the radially-innermost surface of the outlet bell by a radial gap, and wherein a ratio of the radial gap to the maximum blade diameter is about 0.01 to about 0.02.

17. The axial fan assembly of claim 16, wherein the hub includes a radially-outermost surface defining a hub radius (Rhub), wherein the axially-extending, radially-innermost surface of the band defines a band radius (Rband), wherein the radially-outermost surface of the outlet bell defines an outlet radius (Rout), wherein the outlet bell is axially spaced from a downstream blockage by a length dimension (L), wherein a blockage factor is defined by the formula:

$$BlockageFactor = \frac{R_{band}^2 - R_{hub}^2}{2 \times L \times R_{out}}$$

wherein the ratio of the axial gap to the maximum blade diameter is about 0 to about 0.01, and the ratio of the radial gap to the maximum blade diameter is about 0.01 to about 0.02when the blockage factor is greater than or equal to about 0.83.

18. The axial fan assembly of claim 15, wherein the outlet bell includes a radially-innermost surface, a radially-outermost surface, and an end surface adjacent the radially-innermost surface, wherein the leakage stators are positioned between the radially-innermost surface and the radially-outermost surface, wherein the band includes an axially-extending, radially-innermost surface, an axially-extending, radially-outermost surface, and an end surface adjacent the axially-extending, radially-innermost surface and the axially-extending, radially-outermost surface, wherein the axially-extending, radially-outermost surface of the band is spaced radially outwardly of the radially-innermost surface of the outlet bell by a radial gap, wherein a ratio of the radial gap to a maximum blade diameter is about 0 to about 0.01, wherein the respective end surfaces of the band and the outlet bell are spaced by an axial gap, and wherein a ratio of the axial gap to the maximum blade diameter is about 0.01 to about 0.025.

19. The axial fan assembly of claim 18, wherein the hub includes a radially-outermost surface defining a hub radius (Rhub), wherein the axially-extending, radially-innermost surface of the band defines a band radius (Rband), wherein the radially-outermost surface of the outlet bell defines an outlet radius (Rout), wherein the outlet bell is axially spaced from a downstream blockage by a length dimension (L), wherein a blockage factor is defined by the formula:

$$BlockageFactor = \frac{R_{band}^2 - R_{hub}^2}{2 \times L \times R_{out}}$$

wherein the ratio of the radial gap to the maximum blade diameter is about 0 to about 0.01, and the ratio of the axial gap to the maximum blade diameter is about 0.01 to about 0.025 when the blockage factor is less than about 0.83.

20. The axial fan assembly of claim 8, wherein the ratio of blade pitch to average blade pitch does not decrease within the outer 20% of the blade radius.

* * * * *